United States Patent [19]

Dann

[11] 4,126,464

[45] Nov. 21, 1978

[54] LOW TEMPERATURE ADHESIVES FOR PHOTOGRAPHIC MATERIALS

[75] Inventor: John R. Dann, Rochester, N.Y.

[73] Assignee: Eastman Kodak Company, Rochester, N.Y.

[21] Appl. No.: 805,269

[22] Filed: Jun. 10, 1977

[51] Int. Cl.[2] ..... G03C 1/48; G03C 1/78; G03C 1/76; G03C 1/40

[52] U.S. Cl. ..... 96/73; 96/1.5 R; 96/67; 96/76 R; 96/76 C; 96/77; 96/85; 96/87 R; 96/114; 156/332; 156/334; 260/879; 260/885; 260/887; 260/888; 428/522

[58] Field of Search ..... 96/76 R, 67, 77, 76 C, 96/87 R, 1.5, 85, 114, 73; 156/332, 334; 260/880 B, 887, 886, 885, 879, 888, 901; 428/522

[56] References Cited

U.S. PATENT DOCUMENTS

| | | | |
|---|---|---|---|
| 2,485,248 | 10/1949 | Watson et al. | 428/522 |
| 2,601,318 | 6/1952 | Navikas | 154/139 |
| 2,751,322 | 6/1956 | Bost | 154/130 |
| 3,242,033 | 3/1966 | Dallas et al. | 161/253 |
| 3,378,424 | 4/1968 | Sawyer | 156/332 |
| 3,459,700 | 8/1969 | Richards | 260/33.6 |
| 3,630,980 | 12/1971 | Russell | 260/27 |
| 3,644,252 | 2/1972 | Shenfeld et al. | 260/27 R |
| 3,645,817 | 2/1972 | Walker et al. | 156/108 |
| 3,850,858 | 11/1974 | Park | 260/27 BB |
| 3,875,095 | 4/1975 | Yamada et al. | 260/28.5 AV |
| 3,894,117 | 7/1975 | Agouri et al. | 260/876 B |
| 3,925,075 | 12/1975 | Wingender et al. | 96/77 |
| 4,042,395 | 8/1977 | Tone et al. | 96/76 C |

OTHER PUBLICATIONS

Dupont ELVAX Info. Bull., 1970, "ELVAX Acid Terpolymer Resins", pp. 1–12.

"Thermoplastic Rubber . . . Solution Adhesives", Harlan et al., *Adhesives Age,* 12/1972, pp. 30–33.

"Thermoplastic Rubbers . . . Formulations?", Petershagen, *Adhesives Age,* 2/1971.

"Radical Block Thermoplastic Rubbers", Haws, *Org. Coat. Plastic Preprints,* 34(1), 1974, pp. 114–121.

"Contact Adhesives . . . Styrene" Simpson et al., *Adhesives Age,* 9/1974, pp. 32–35.

"Styrene–Olefin Block Polymers", Clair et al., *Adhesives Age,* 11/1975, pp. 39–44.

*Primary Examiner*—Richard L. Schilling

*Attorney, Agent, or Firm*—Arthur H. Rosenstein

[57] ABSTRACT

Disclosed herein are non-pressure sensitive, heat sealable adhesive compositions having high bonding strengths at temperatures below 75° C which consist essentially of a mixture of a block copolymer of a vinylbenzene and a conjugated diolefin, and a copolymer of an alkene and vinyl acetate. These adhesives are useful in a variety of radiation sensitive materials, but particularly in photographic materials such as photographic film units. In such units, they are particularly useful to bond barrier timing layers to other layers or substrates, but also may be used to bond other layers or substrates.

46 Claims, No Drawings

LOW TEMPERATURE ADHESIVES FOR PHOTOGRAPHIC MATERIALS

BACKGROUND OF THE INVENTION

1. Field of the Invention

This invention relates to polymeric adhesive compositions and their use in radiation sensitive elements, and more particularly in photographic materials such as diffusion transfer film units. In particular, this invention relates to heat-sealable non-pressure sensitive adhesive compositions useful at low temperatures comprising mixtures of vinylbenzenediolefin block copolymers and copolymers of alkenes and vinyl acetate.

2. Description of the Prior Art

It is well known that certain copolymers or copolymer blends are useful as adhesives. For instance, U.S. Pat. Nos. 2,485,248 of Watson et al. and 3,232,895 of Klein et al. relate to low temperature, pressure-sensitive adhesive compositions comprising a copolymer of ethylene and vinyl acetate. U.S. Pat. No. 3,378,424 of Sawyer discloses the use of adhesive compositions containing copolymers of ethylene and vinyl acetate in laminates. Hot melt coating agents and adhesives which comprise ethylene-vinyl acetate copolymers and resins prepared by copolymerizing vinyl aromatic hydrocarbons containing isopropenyltoluene and a by-product fraction obtained in refining or cracking petroleum are described in U.S. Pat. No. 3,875,095 of Yamada et al.

Copolymers of vinyl aromatics, such as styrene, and conjugated diolefins have also been used as adhesives as disclosed in U.S. Pat. Nos. 2,601,318 of Navikas; 2,751,322 of Bost; 3,242,038 of Dallas et al.; 3,459,700 of Richards; 3,645,817 of Walker et al.; and 3,850,858 of Park.

U.S. Pat. No. 3,630,980 of Russell discloses pressure-sensitive adhesives having good quick tack at room temperature. These adhesives comprise (a) an ethylene-vinyl acetate copolymer; (b) a block copolymer of styrene and a conjugated diolefin; and (c) a third resin, such as a coumarone-indene resin, polystyrene resin, etc, which provides instant tackiness and allows the adhesive blend to be made without the use of solvents. No photographic uses are disclosed for these adhesives.

In U.S. Pat. No. 3,644,252 of Shenfield et al. are disclosed hot-melt, pressure sensitive adhesive compositions useful at elevated temperatures (above 120° C.) comprising random copolymers of styrene and olefins and copolymers of ethylene and vinyl acetate. No photographic uses are taught or suggested for these adhesives.

Compositions for making rigid, extruded articles are disclosed in U.S. Pat. No. 3,894,117 of Agouri et al. These compositions comprise an ethylene-vinyl acetate copolymer and a block copolymer of styrene and an olefin. No mixtures containing block copolymers of styrene and diolefins and no adhesive or photographic uses are taught or suggested.

Radial block thermoplastic rubbers can be used in a variety of adhesive applications, such as pressure sensitive adhesives, contact cements and hot melts as indicated by J. R. Haws in *Organic Coatings and Plastic Preprints*, 34(1), pages 114 through 121 (1974).

Various formats for photographic film units are described in U.S. Pat. Nos. 2,352,014 of Rott; 2,543,181 of Land; 2,983,606 of Rogers; 3,020,155 of Yackel et al.; 3,227,550 and 3,227,552 of Whitmore et al.; 3,415,644; 3,415,645, and 3,415,646, all of Land; and 3,635,707 of Cole; Canadian Pat. Nos. 674,082 of Whitmore, and 928,559 of Cole; U.S. Pat. Nos. 3,362,819; 3,362,821, and 3,647,437, all of Land; and 3,756,815 of Schlein et al.; Belgian Pat. Nos. 757,959 and 757,960; British Pat. Nos. 904,364 and 840,731; and copending U.S. application Ser. No. 676,945 of Hannie, and Ser. No. 676,947 of Hannie et al., both filed Apr. 14, 1976 and now U.S. Pat. Nos. 4,056,394 and 4,061,496 respectively. None of the prior art teaches or suggests the adhesive compositions disclosed herein or their use in photographic materials.

In these formats, the image-receiving layer containing the photographic image for viewing can be separated from the photographic layers after processing or, in some embodiments, it can remain permanently attached and integral with the image-generating and ancillary layers present in the structure when a transparent support is employed on the viewing side of the assemblage. The image is formed by color-providing substances released from the image-generating units, diffusing through the layers of the structure to the dye image-receiving layer. After exposure of the assemblage, an alkaline processing composition permeates the various layers to initiate development of the exposed photosensitive silver halide emulsion layers. The emulsion layers are developed in proportion to the extent of the respective exposures, and the color-providing materials which are formed or released in the respective image-generating layers begin to diffuse throughout the structure. At least a portion of the imagewise distributed or released color-providing substances migrate to the dye image-receiving layer to form an image of the original subject.

Typically, adhesives are used in photographic film units to bond supports, subbed or unsubbed, to cover sheets or other layers around the edges of the units. Adhesives can also be used to bond subbing layers to supports or cover sheets, photosensitive layers to image-receiving layers, and the like.

It has been desirable to provide high strength adhesives for bonding barrier timing layers to spacer rail substrates which generally separate the photosensitive element of the film unit from a barrier timing layer-containing cover sheet. However, due to the many prerequisites for acceptable bond strengths at low temperatures of barrier timing layers to spacer rail substrates, none of the prior art adhesives are useful in these photographic materials. Prior art adhesives sometimes have desired bond strengths at temperatures above 25° C. and below 70° C. but not below 25° C., and especially not at 5° C. or lower. The pressure sensitive (instant tackiness) adhesives are not useful in these image transfer units as they are not conducive to heat or dielectric sealing, long-term storage or transport on sealing machines. Further, prior art adhesives do not adequately adhere to some of the materials prominently used as barrier timing layers or spacer rail substrates.

It is evident, then, that there is a need in the photographic arts for heat-sealable, non-pressure sensitive adhesives which exhibit high bond strengths at temperatures below about 75° C., and especially below 25° C.

SUMMARY OF THE INVENTION

It has been unexpectedly found, according to the present invention, that mixtures of certain block copolymers and copolymers formed from ethylenically unsaturated monomers are useful as adhesive compositions in radiation-sensitive materials. These adhesives have high bond strengths at low temperatures, such as below 75°

C. and as low as 5° C. or lower, and can be used to bond various layers of photographic elements, and particularly barrier timing layers to other layers in photographic film units.

One aspect of the present invention comprises a nonpressure sensitive, heat sealable adhesive composition having high bond strength at temperatures below about 25° C., consisting essentially of a mixture of from about 1 to about 99 percent by weight of a block copolymer formed from about 10 to about 50 percent by weight of at least one vinylbenzene and from about 90 to about 50 percent by weight of at least one conjugated diolefin; and from about 99 to about 1 percent by weight of a copolymer formed from about 40 to about 85 percent by weight of at least one alkene and from about 60 to about 15 percent by weight of vinyl acetate.

In another aspect of the present invention, a radiation-sensitive element comprises a support having thereon at least one radiation-sensitive layer and the nonpressure sensitive, heat-sealable adhesive composition described hereinabove.

A further aspect of the present invention comprises a photographic film unit comprising a support having thereon at least one photosensitive silver halide emulsion layer having associated therewith a dye image-providing material; a dye image-receiving layer; means for discharging an alkaline processing composition within the film unit in contact with the photosensitive layer; a neutralizing layer for neutralizing the alkaline processing composition; a barrier timing layer which is permeable by the alkaline processing composition after a predetermined time located between the neutralizing layer and the photosensitive silver halide emulsion; the film unit containing a silver halide developing agent and the non-pressure sensitive, heat sealable adhesive composition described hereinabove.

DETAILED DESCRIPTION OF THE INVENTION

As described hereinabove, from about 1 to about 99 percent by weight of the adhesive compositions of the present invention, and preferably from about 10 to about 30 percent by weight, is one or more block copolymers formed from at least one vinylbenzene and at least one conjugated diolefin. Exemplary vinylbenzene monomers include those having 8 to 12 carbon atoms such as styrene, vinyltoluene, α-methylstyrene, tert-butylstyrene, 2,6-dimethylstyrene, ethylstyrene and the like and similar compounds having one or more simple or small substituents not adversely affecting polymerizable properties, such as halides, hydroxy, amino, nitro, one to four carbon alkoxy and the like. Conjugated diolefins which can be used include linear or cyclic diolefins such as those having from 4 to 12 carbon atoms which may be substituted or unsubstituted, such as butadiene, isoprene, 1,3-pentadiene, 1,3-hexadiene, cyclopentadiene, 1,3-cyclohexadiene, 1-chlorobutadiene and isomers thereof and the like.

Rubbery block copolymers especially useful in the adhesive compositions of this invention are those having groups or blocks of polystyrene-polybutadiene-polystyrene or polystyrene-polyisoprene-polystyrene. The poly(vinylbenzene) or polystyrene groups generally have molecular weights of from about 5000 to about 125,000, preferably between about 8000 and 45,000, whereas the polydiolefin or polybutadiene or polyisoprene blocks generally have molecular weights of between about 15,000 and about 250,000, preferably from about 35,000 to about 150,000. The respective block molecular weights can be added to obtain a molecular weight for the block copolymer. As used herein, molecular weight will mean the number average molecular weight $\overline{M}_n$. The significance of this conventional molecular weight term, as well as methods for its determination, are more fully described in *Textbook of Polymer Science,* 2nd Edition, F. W. Billmeyer, Jr., Wiley-Interscience, New York, 1971, Chapter 3.

The block copolymers generally contain from about 10 to about 50 percent by weight of the poly(vinylbenzene) blocks, preferably from about 20 to about 30 percent; and from about 90 to about 50 percent by weight of the polydiolefin blocks, preferably from about 70 to about 80 percent.

Typically, the block copolymers useful in this invention have two glass transition temperatures ($T_g$). The $T_g$ for the diolefin blocks of the copolymer typically is within the range of from about −80° to about 0° C., and preferably from about −75° C. to about −55° C., and that for the vinylbenzene blocks is in the range of from about 50° to about 150° C., and preferably from about 80° to about 120° C. The glass transition temperatures, as used herein, unless otherwise specified, can be determined by differential scanning calorimetry as disclosed in "Techniques and Methods of Polymer Evaluation," Volume 2, Marcel Dekker, Inc., New York, 1970.

The particular disclosed glass transition temperatures, proportions of components and molecular weight of all of the copolymers useful herein are critical in order for the adhesive compositions to be non-pressure sensitive and to have high bond strengths. Pressure sensitive compositions are not useful herein because they cannot be stored in roll form or transported on the assembly machine for sealing. By high bond strength is meant that generally the peel force strength of the composition useful herein is greater than the sum of the individual strengths of the component copolymers at 5° C., and of the order of 394 g/cm or greater.

Methods of making the block copolymers described above are well known to those skilled in the art and are disclosed in U.S. Pat. Nos. 2,751,322 of Bost; 3,242,038 of Dallas et al.; 3,459,700 of Richards; and 3,646,161 of Marwede et al., hereby incorporated by reference. Commercially available block copolymers which are useful include those marketed by Shell Chemical Company under the trade term KRATON and those marketed by Phillips Petroleum Company under the trade term SOLPRENE, such as KRATON 1107 (linear copolymer of polystyrene-polyisoprene-polystyrene), KRATON 1102 (linear copolymer of polystyrene-polybutadiene-polystyrene), and SOLPRENE 406 (radial copolymer of polystyrene and polybutadiene). The physical properties of these and other commercial block copolymers are described in Haws, *Organic Coatings and Plastics Preprints,* 34(1), pages 114 through 121 (1974); Petershagen, *Adhesives Age,* "Thermoplastic Rubbers . . . How Are They Used in Adhesive Formulations?", February, 1971; Simpson et al., *Adhesives Age,* "*Contact Adhesives Based on Radical Block Copolymers of Butadiene and Styrene*", *pages* 32 through 35 (September, 1974); St. Clair et al., *Adhesives Age,* "Styrene-Olefin Block Polymers", pages 39 through 44 (November, 1975); Shell Chemical Company Technical Bulletin S.6.72-2, "Kratons", 72-1; 72-3, and 72-4; Compounds and Processing SOLPRENE radial block copolymers; Phillips Petroleum Company Technical Report 804-P-TR; and Harlan et al., *Adhesives Age,* "Thermoplastic Rubber in Hot Melt and Solution Adhesives", pages 30 through 33 (December, 1972), all of which are hereby incorporated by reference.

Copolymers of an alkene and vinyl acetate useful in the present invention include those made from vinyl acetate and one or more substituted or unsubstituted alkenes having up to 5 carbon atoms in the backbone, such as ethylene, propylene, butylene, iso-propylene, pentylene, iso-butylene and the like. The alkenes can be substituted with various substituents such as halides or other small moieties known to those skilled in the art which do not substantially affect the properties of the compounds. A preferred copolymer is one of ethylene and vinyl acetate. Such copolymers generally contain from about 15 to about 60 percent by weight of vinyl acetate, preferably from about 25 to about 35 percent, with the remainder being the weight of one or more alkenes.

Typically, the useful alkene-vinyl acetate copolymers have number average molecular weights ($\overline{M}_n$) within the range of from about 10,000 to about 100,000 and preferably from about 20,000 to about 60,000. Generally, these copolymers have glass transition temperatures within the range of from about −50° to about +30° C., preferably from about −30° to about 0° C.

Methods of making these copolymers are well known to those skilled in the art and are disclosed in U.S. Pat. Nos. 2,200,429 of Perrin; 2,485,248 of Watson et al.; 2,703,794 of Roedel; and 3,232,895 of Klein et al., which are hereby incorporated by reference. Commercially available ethylene and vinyl acetate containing copolymers that are preferred include those marketed by E. I. duPont de Nemours under the trade term ELVAX, and those marketed by Borden Chemical Company, such as the HA6164 adhesive. The physical properties of these and similar materials are discussed in DuPont ELVAX Product Information Bulletin of 1970 entitled "ELVAX Acid Terpolymer Resins", and the above-mentioned U.S. patents, all of which are hereby incorporated by reference.

Preferably, the adhesive compositions of the present invention consist essentially of from about 10 to about 30 weight percent of one or more block copolymers and from about 70 to about 90 percent by weight of one or more alkene-vinyl acetate copolymers. The properties of the adhesives, such as cold flow and melt temperature for blending and application can be modified by a proper selection of the number and proportion of copolymers.

The adhesive compositions of this invention can be modified with various materials to result in compositions which exhibit additional useful properties or decrease their cost. These materials which comprise plasticizers, mineral fillers, pigments, antioxidants, UV-absorbers and resin extenders are not critical to the present invention but are regularly used in the adhesive art to tailor the composition to a specific need.

The use of plasticizers in the compositions of the present invention can be desirable and will often enhance the coatability of the product by adjusting its viscosity at those temperatures at which the adhesive compositions are applied to a substrate. Exemplary plasticizers which are used in the art and which can be suitably utilized in the compositions of the present invention are petrolatum, mineral oil, chlorinated paraffins, diisobutyl phthalate, tricresyl phosphate, dioctyl phthalate, propylene glycol dibenzoate, chlorinated aromatic compounds, lower aliphatic esters of adipic acid, lower aliphatic esters of sebacic acid and the like. The amount of plasticizer which can be used in the adhesive compositions can range up to about 20 percent by weight of the total composition.

Mineral fillers are commonly used in adhesive compositions as extenders to improve the economics of the formulation and often impart creep resistance thereto. When used, these fillers can comprise up to about 30 percent by weight of the total formulation. Fillers which can be used in the compositions of this invention are exemplified by calcium carbonate, barium sulfate, silica, talc, china clay and bentonite.

Antioxidants and UV-absorbers can be incorporated into the adhesive compositions of this invention to improve their aging characteristics. Useful antioxidants and UV-absorbers are butylated hydroxy toluene, butylated hydroxy anisole, diphenolic hindered antioxidants, and the like, such as 4,4-methylenebis(2,6-di-t-butylphenol) and tris(di-t-butyl-p-hydroxybenzyl)-trimethylbenzene. Ordinarily, about 0.05 to about 1.0 percent by weight of antioxidant or UV-absorber, based on total adhesive composition weight, is sufficient.

The adhesive compositions of this invention can also be modified or extended with polymeric materials having a softening point (ring and ball method) of from about 90° to about 170° C. and having a melt index of from about 2 to about 300. These materials can be hydrocarbon resins such as are commonly prepared from an atactic polypropylene and polyethylene or resins such as rosin derivatives, terpene resins, including alpha- and beta-pinene resins, and the like. The use of such extending resins is common practice in the adhesive art, especially for the purpose of lowering formulation costs or modifying the formulation to fit specific needs.

Other addenda commonly included in adhesives are waxes, such as, for example, stearamides, stearates, for example, glyceryl tri(12-hydroxystearate) and the like; which may serve as antiblocking agents and also to give better transport on sealing machine conveyors.

The adhesive compositions described herein are formulated by any convenient method of mixing, whereby the component copolymers and any desired addenda are mixed at a temperature within the range of from about 25° to about 100° C. in a suitable solvent (depending upon the boiling point), such as aromatic solvents, including toluene, xylene and the like; or chlorinated solvents including trichloroethane, methylene chloride and the like; alcohols, including methanol, ethanol, propanol and the like; ketones such as acetone, methyl ethyl ketone and the like; and mixtures of any of these, at about from 2 to about 25 percent solids.

A particular advantage of the adhesive compositions of the present invention is that they can be coated over a wide range of temperatures without a loss in resulting peel strength. Generally, better homogeneous coatings can be achieved at higher temperatures, such as 50° C. or higher. However, prior art adhesive coatings containing the block copolymer alone exhibit a marked decline in peel strength when coated at these temperatures. Mixtures of the invention, however, can be coated from solvents such as toluene at any temperature, including 50° C. and retain excellent peel strength.

The adhesive compositions of the present invention can be used in a variety of radiation-sensitive elements, including lithographic, electrophotographic, electrographic materials and particularly photograhic materials. They can be used to bond subbing layers to supports or to radiationsensitive layers, or as subbing layers, or to splice unexposed or exposed film. Generally, they are useful to bond any layer to another, but particularly polymeric layers to other polymeric layers or to paper.

Preferably, the adhesives are used in photographic elements such as radiographic elements, direct-positive elements, negative image-forming element, thermally processable elements, multilayer multi-color elements, high contrast elements and the like. The resulting photographic elements are panchromatic or orthochromatic. Other typical elements and suitable photographic silver halide emulsions are disclosed in *Product Licensing Index,* Volume 92, December, 1971, publication 9232, pages 107 through 110, hereby incorporated by reference.

Suitable silver halide emulsions are disclosed in paragraphs I and II of *Product Licensing Index,* cited above. The silver halide emulsions can contain various addenda and vehicles as disclosed in paragraphs III–VIII and XI–XVI. They may be coated on various supports as described in paragraph X. The photographic layer or layers can be present in combination with one or more conventional subbing layers, interlayers, overcoats and the like.

The photographic elements of the present invention can be prepared and processed by any convenient conventional technique. Illustrative preparation techniques are disclosed in *Product Licensing Index,* cited above, paragraphs XVII and XVIII; and exemplary processing techniques are disclosed in paragraph XXIII.

Depending upon the particular layers bonded together and the bonding strengths desired, typical coating concentrations of the described adhesive compositions can be within the range of from about 6 to about 26 grams/$m^2$ of substrate.

In a preferred embodiment of the present invention, the described adhesives are used in photographic film units wherever there is a need to bond two layers, such as subbed or unsubbed supports to cover sheets, subbing layers to supports to cover sheets, photosensitive layers to image-receiving layers, and the like. Preferably, the adhesive compositions are useful to bond barrier timing layers, such as those disclosed in U.S. application Ser. Nos. 676,945 and 676,947 of Hannie and Hannie et al., respectively, both filed Apr. 14, 1976, now U.S. Pat. Nos. 4,056,394 and 4,061,496, respectively, to other layers, such as spacer rail substrates made of paper, polymers or other materials.

Adhesives which are acceptable for this latter use desirably possess the following characteristics:

(a) Non-pressure sensitive and heat sealable;

(b) High bond strength, as exhibited by peel force strength, at temperatures below about 75° C.;

(c) Good adherence to materials typically used as barrier timing layers and spacer rail substrates;

(d) Adhesive seals able to withstand four hours' exposure to 80° C. temperature (glove box test);

(e) Adhesive seal which will not leak in processing at temperatures as low as −12° C.;

(f) Capable of being sealed as a dry coating in about 0.2 seconds at a temperature not exceeding 110° C.; and (g) Susceptible to solvent-gravure coating.

The adhesive compositions of the present invention have been found to have these characteristics whereas those of the prior art have not.

In addition to the adhesives described herein, a photographic film unit of the present invention comprises the following components:

(a) a support having thereon at least one photosensitive silver halide emulsion layer having associated therewith a dye image-providing material;

(b) a dye image-receiving layer;

(c) means for discharging an alkaline processing composition within the film unit in contact with the photosensitive layer;

(d) a neutralizing layer for neutralizing the alkaline processing composition; and (e) a barrier timing layer which is permeable by the alkaline processing composition after a predetermined time located between the neutralizing layer and the photosensitive silver halide emulsion.

In one embodiment according to this invention, the film units are integral negative-receiver color diffusion transfer film units in which adhesives of the invention can be employed between a cover sheet as disclosed in Canadian Pat. No. 928,559 and the photosensitive element. In this embodiment, the support for the photosensitive element is transparent and is coated with the image-receiving layer, an opaque light-reflective layer, a black opaque layer and photosensitive layers having associated therewith dye image-providing materials. A rupturable container containing an alkaline processing composition and an opacifier such as carbon black is positioned adjacent the top layer and a transparent cover sheet. The cover sheet comprises a transparent support which is coated with a neutralizing layer and a barrier timing layer. The adhesive composition of this invention is used to bond the barrier timing layer to a spacer rail substrate which separates the barrier timing layer from the photosensitive layers. The film unit is placed in a camera, exposed through the transparent cover sheet and then passed through a pair of pressure-applying members in the camera as it is being removed therefrom. The pressure-applying members rupture the container and spread processing composition and opacifier over the image-forming portion of the film unit. The silver halide layers are developed and dye images are formed as a function of development. The dyes diffuse to the image-receiving layer to provide an image which is viewed through the transparent support on the opaque reflecting layer background. The barrier timing layer or layers break down after a period of time and made available materials to neutralize the alkaline processing composition and to shut down further silver halide development. For further details concerning the format of this particular integral film unit, reference is made to the above-mentioned Canadian Pat. No. 928,559, which is incorporated herein by reference.

Another embodiment of an integral color diffusion transfer film unit in which the adhesives of the invention can be employed in a dye image-receiving element is described in U.S. Pat. No. 3,415,644 of Land. In this embodiment, the photosensitive element comprises an opaque support which is coated with photosensitive layers having associated therewith dye image-providing material layers. A rupturable container containing an alkaline processing composition, $TiO_2$ and an indicator dye (see U.S. Pat. No. 3,647,437) is positioned adjacent the top layer and a transparent receiver. The receiver comprises a transparent support which is coated with a neutralizing layer, a barrier timing layer and an image-receiving layer. The film unit is placed in a camera, exposed through the transparent receiver and then passed through a pair of pressure-applying members in the camera as it is being removed therefrom. The pressure-applying members rupture the container and spread processing composition, $TiO_2$ and indicator dye over the image-forming portion of the film unit to protect it from exposure. The processing composition develops each silver halide layer and an imagewise distribution of diffusible dye remains in areas which are not developed, and said dye diffuses to the image-receiving layer where it can be viewed through the transparent support on a white background, the indicator dye having "shifted" to a colorless form as the alkali is consumed by the neutralizing layer. As before, the neutralizing layer then neutralizes the alkaline processing composition after the barrier timing layer breaks down. The adhesive of this invention can be used to bond the wrap-around mask to the imaging layers. For further details concerning the format of this particular film unit, reference is made to the above-mentioned U.S. Pat. No. 3,415,644, which is incorporated herein by reference.

Another embodiment of a color diffusion transfer system in which the adhesives of the invention can be employed in a dye image-receiving element is described in U.S. Pat. No. 3,362,819 of Land. The image-receiving element comprises a support which is usually opaque, having thereon a neutralizing layer, a barrier timing layer and a dye image-receiving layer. For further details concerning the use of such an element in color transfer film units, reference is made to the above-mentioned U.S. Pat. No. 3,362,819, which is incorporated herein by reference.

Still other useful integral formats in which this invention can be employed are described in U.S. Pat. Nos. 3,415,645; 3,415,646; 3,647,437; 3,635,707; and 3,594,165 and British Pat. No. 1,330,524.

The timing layer of the photographic film unit serves to delay the release of acid from the neutralizing layer for a predetermined period. The timing layer may be an inert layer, in which case the delay results principally from the time required for the alkali to physically pass through the layer. Inert timing layers, even when very thick, only provide for a short delay. Examples of inert timing layers are layers of gelatin, poly(vinyl alcohol) carboxymethylcellulose, polyacrylamide and the like. Alternatively, the timing layer may be a barrier timing layer in which case the delay results not only because of the time required for physical permeation but principally because of the time required for chemical reaction. A barrier timing layer is initially substantially impermeable and time is required to allow the aqueous alkaline solution to react with the layer and increase its permeability. Usually the permeability increasing reaction that takes place is the hydrolysis or neutralization of the layer by the alkaline solution. Typically therefore, a barrier timing layer comprises a substantially alkaline solution impermeable material which can be hydrolyzed or neutralized by the alkaline solution to a substantially alkaline solution permeable material. Examples of barrier timing layers include layers of cellulose acetate phthalate and the like.

Preferred barrier timing layers for use in the film units of the present invention include those of U.S. Ser. Nos. 676,945 of Hannie and 676,947 of Hannie et al. mentioned hereinabove. Hannie discloses barrier timing layers comprising polymeric latexes having an activation energy of penetration by aqueous alkaline solution of greater than 18 kcal/mole. Hannie et al. discloses barrier timing layers which comprise two adjacent barrier timing layers, one of which comprises a polymeric latex having an activation energy of penetration to aqueous alkaline solution of less than 18 kcal/mole and the second, a polymeric latex like those disclosed in Hannie.

The activation energy of penetration of polymeric layers by aqueous alkaline solutions can be determined by the following simple test.

A thymolphthalein dye or cresol red dye indicator is coated on a polyethylene terephthalate film support at 210 mg/m$^2$ with 6.6 gm/m$^2$ gelatin in the case of thymolphthalein or 2.2 gm/m$^2$ in the case of cresol red.

A processing composition comprising a pod which contains about 0.84 N potassium hydroxide and about 5% carboxymethyl cellulose in water, along with other conventional developer ingredients, is spread between the element containing the indicator dye and a sample of a cover sheet by passing the "sandwich" between a pair of juxtaposed pressure rollers so that the developer layer thickness is 0.1 mm.

The cover sheet comprises a poly(ethylene terephthalate) support containing a first layer of a 30/70 (by weight) copolymer of poly(butyl acrylate-co-acrylic acid), a second layer of 50/50 (mole ratio) polymer of poly(styrene-co-maleic anhydride) at 2.2 g/m$^2$ and the outer layer being the polymer for which the activation energy is to be determined.

The time required to reduce the pH of a unit to pH 10 as measured by the color change of the thymolphthalein dye from blue to colorless or to pH 8 as measured by the change of the cresol red dye from red to yellow is measured at various temperatures within the range of 13° to 54° C. The time in seconds is plotted on a logarithmic scale against the reciprocal of the temperature expressed in °K. The activation energy in kcal/mole is determined from the slope of the straight line portion of the curve according to the formula $$-E_a \text{ (activation energy)} = 0.00458 \times \frac{\log Y_2/Y_1}{1/T_2 - 1/T_1}$$

where $T_2$ is the higher temperature and $T_1$ is the lower temperature and $Y_2$ is the time at $T_2$ and $Y_1$ is the time at $T_1$. The thickness of the acid layer and the polymer layer is not critical to the proper determination of activation energy.

A discussion of activation energy calculations can be found in *Kinetics and Mechanism,* 2nd edition, N.Y., John Wiley and Sons, 1961, pp. 22–25.

Examples of polymers having an activation energy of less than 18 kcal/mole are mixtures of cellulose acetate and maleic anhydride copolymers like those described in U.S. application Ser. No. 521,221 of Abel, filed Nov. 5, 1974, now U.S. Pat. No. 4,009,030 including poly(styrene-co-maleic anhydride), poly(ethylene-co-maleic anhydride), poly(methyl vinyl ether-co-maleic anhydride) and the like.

The maleic anhydride copolymer should be employed in a concentration of about 2 to about 20% by weight, depending somewhat on the other comonomer. A 5–20% concentration has been found to be particularly effective. The thickness of the barrier timing layer should be such to provide a coverage of about 5 grams/m$^2$.

The cellulose acetate employed will usually have acetyl contents of about 37–40% by weight, the 37% being substantially more permeable than the 40% acetal. Mixed esters can also be employed such as cellulose acetate propionate, cellulose acetate butyrate, etc.

A portion of the anhydride of the maleic anhydride copolymer used may also be hydrolyzed to the corresponding acid prior to use. For example, poly(styrene-co-maleic anhydride) was analyzed and found to contain 8 mole percent maleic anhydride, 7 mole percent monomethyl maleate, 26 mole percent maleic acid and 59 mole percent styrene. It is seen, therefore, that the mole percent of maleic anhydride in the copolymer can vary over a wide range, with about 30% to about 50% generally providing good results.

Examples of other layers containing polymers having an activation energy of less than 18 kcal/mole are poly(-vinyl acetate), cellulose acetate phthalate, partial acetals of poly(vinyl alcohol), a polymer latex of butyl acrylate-diacetone acrylamide-styrene-methacrylic acid (60/30/4/6) as described in U.S. Pat. No. 3,785,815, mixtures of poly(vinyl acetate) and poly(vinyl alcohol) such as poly(vinyl acetate) latex in 78/22 ratio with poly(vinyl alcohol), cellulose acetate (40% acetate in 95/5 ratio with poly(styrene-co-maleic anhydride) (50/50 mole ratio) as described in U.S. application Ser. No. 521,221, and the like.

Preferred polymeric latexes having an activation energy of penetration to aqueous alkaline solution of greater than 18 kcal/mole of polymers of from about 5 to about 35 percent by weight of polymerized ethylenically unsaturated monomer from about 2 to about 10 percent by weight of polymerized ethylenically unsaturated carboxylic acid and from about 55 to about 85 percent by weight of polymerized vinylidene chloride.

Any ethylenically unsaturated monomer can be used to prepare the polymer including alkyl acrylates and methacrylates such as methyl acrylate, ethyl acrylate, propyl acrylate, butyl acrylate, butyl methacrylate and the like; vinyl esters, amides, nitriles, ketones, halides, ethers, olefins, diolefins and the like as exemplified by acrylonitrile, methacrylonitrile, styrene, alpha-methyl styrene, acrylamide, methacrylamide, vinyl chloride, methyl vinyl ketone, furmaric, maleic and itaconic esters, 2-chloroethyl vinyl ether, dimethylaminoethyl methacrylate, 2-hydroxyethyl methacrylate, N-vinylsuccinamide, N-vinylphthalimide, N-vinylpyrrolidone, butadiene, ethylene and the like. Preferred monomers are methyl acrylate and acrylonitrile.

Examples of ethylenically unsaturated carboxylic acids which can be included in the polymer include acrylic acids, methacrylic acid, itaconic acid, fumaric acid, maleic acid, their anhydrides, and the like. The preferred carboxylic acids are acrylic acid and itaconic acid.

The latex polymers can be prepared by polymerizing the monomers in water. For example, a terpolymer comprising 15 weight percent acrylonitrile, 80 weight percent of vinylidene chloride and 5 weight percent of acrylic acid can be prepared by charging into a reactor 4.5 g of potassium persulfate dissolved in water, stirring, cooling to 20° C. and purging with nitrogen and adding 257 g of acrylonitrile, 1453 g of vinylidene chloride, 90 g of acrylic acid and 450 g of surfactant. To this is added a solution of 2.25 g of potassium peroxydisulfate or persulfate in water and the reaction is continued at 30° C. and 150 revolutions per minute stirring.

A wide variety of surfactants can be used to coat the latex. For example, the addition to the latex before coating of up to 4 percent by weight of surfactants such as Triton X-100 (believed to be p-octylphenoxypolyethoxyethanol) or solvents such as methyl cellosolve may aid in the coating uniformity of the latex.

Another preferred polymer comprising 15 weight percent methyl acrylate, 83 weight percent vinylidene chloride and 2 weight percent itaconic acid is prepared by generally the same method as described above.

Further examples of latex polymers useful herein can be found in U.S. Pat. Nos. 3,271,345; 2,627,088; 2,491,023; 2,779,684; 3,437,484; 2,943,937, and 3,143,421.

In a number of embodiments, it is advantageous to affix various film unit components to the cover sheet. For example, it may be advantageous to affix so-called spacer rail substrates to the edges of the cover sheet so as to more precisely define the space between the cover sheet and the image generating element into which the alkaline processing composition is discharged. Spacer rail substrates can be made of paper, various polymers such as poly(ethylene terephthalate), subbed or unsubbed, and the like. They are described, for example, in U.S. patent application Ser. No. 778,635 by Sandhu and Tingler, filed Mar. 17, 1977.

Bonding of layers with the adhesive compositions described herein can be accomplished with heat or dielectric means or a combination of the two. Heat can be applied with devices having heated plates, rollers, drums or jaws. Bonding temperatures are usually less than 163° C. (325° F.). Bonds can be made with dielectric-hot jaw sealing devices at energy levels of from about 800 to about 1600 watts and from about 90 to about 110 megahertz with the heated jaw at from about 25° C. to about 163° C. Sealing times vary from about 0.1 to about 1 second. Jaw pressure can vary from about 2.72 to 3.4 atmospheres.

The photosensitive element useful in this invention can be treated with an alkaline processing composition to effect or initiate development in any manner. A preferred method for applying processing composition is by use of a rupturable container or pod which contains the composition. In general, the processing composition employed in this invention contains the developing agent for development, although the composition could also be just an alkaline solution where the developer is incorporated in the photosensitive element, in which case the alkaline solution serves to activate the incorporated developer.

The dye image-providing materials which may be employed in this invention generally may be characterized as either (1) initially soluble or diffusible in the processing composition but selectively rendered nondiffusible in an imagewise pattern as a function of development, such as those disclosed, for example, in U.S. Pat. Nos. 2,647,049; 2,661,293; 2,698,244; 2,698,798; 2,802,735; 2,774,668, and 2,983,606, or (2) initially insoluble or nondiffusible in the processing composition but providing a diffusible image dye-providing material as a function of development, such as those disclosed, for example, in U.S. Pat. Nos. 3,227,550; 3,227,551; 3,227,552; 3,227,554; 3,243,294, and 3,445,228. These materials may contain preformed dyes or dye precursors, e.g., color couplers, oxichromic compounds and the like.

In a preferred embodiment of this invention, the dye image-providing material is a ballasted redox dye releaser. Such compounds are, generally speaking, compounds which can be oxidized, i.e., crossoxidized, by an oxidized developing agent to provide a species which, as a function of oxidation, will release a diffusible dye, such as by alkaline hydrolysis. Such redox dye releasers are described in U.S. Pat. Nos. 3,725,062 of Anderson and Lum, issued Apr. 3, 1973; 3,698,897 of Gompf and Lum, issued Oct. 17, 1972; 3,628,952 of Puschel et al., issued Dec. 21, 1971; and 3,443,939 of Bloom et al., and 3,443,940 of Bloom et al., both issued May 13, 1969, and the following copending applications: Ser. Nos. B351,673 of Fleckenstein et al., published Jan. 28, 1975 and 351,700 of Fleckenstein, now U.S. Pat. No. 3,928,312 both filed Apr. 16, 1973; 331,727 and 331,729 of Landholm et al., both filed Feb. 12, 1973 both now abandoned; 331,728 of Haase et al., filed Feb. 12, 1973 now abandoned; and 326,628 of Hinshaw et al., filed Jan. 26, 1973 now abandoned; the disclosures of which are hereby incorporated by reference.

The term "nondiffusible" as used throughout the specification is intended to mean that the material will not substantially diffuse either within or from the layer in which it is located within the photographic element during contact in an alkaline solution at a pH, for example, of greater than 11. In most cases, the material is ballasted so as to render it nondiffusible. Likewise, the term "diffusible" is intended to mean that the material when in contact with alkaline solution under conditions similar to those described above will substantially migrate from its layer in the photographic element to the image-receiving layer where it is mordanted.

In one preferred embodiment of this invention, the redox dye releasers in the Fleckenstein et al. published application Ser. No. B351,673 referred to above are employed. Such compounds are nondiffusible sulfonamido compounds which are alkali-cleavable upon oxidation to release a diffusible sulfonamido dye. In certain preferred embodiments, the compounds have the formula:

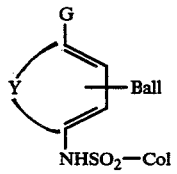

wherein:

(1) Ball represents an organic ballasting group (preferably containing at least 8 carbon atoms) which renders said compound nondiffusible in a photographic element during processing of said element with an alkaline composition;

(2) Y represents the carbon atoms necessary to complete a benzene, naphthalene or heterocyclic nucleus;

(3) G is OR or $NHR_1$ wherein R is hydrogen or a hydrolyzable moiety and $R_1$ is hydrogen or a substituted or unsubstituted alkyl group of 1 to 22 carbon atoms, such as methyl, ethyl, hydroxyethyl, propyl, butyl, secondary butyl, tert-butyl, cyclopropyl, 4-chlorobutyl, cyclobutyl, 4-nitroamyl, hexyl, cyclohexyl, octyl, decyl, octadecyl, docosyl, benzyl, phenethyl, etc. (when $R_1$ is an alkyl group of greater than 6 carbon atoms, it can serve as a partial or sole Ballast group); and (4) Col is a dye or dye precursor moiety.

For further details concerning the above-described sulfonamido compounds and specific examples of same, reference is made to the above-mentioned Fleckenstein et al. application Ser. No. 351,673 and Belgian Pat. No. 799,268, issued Feb. 28, 1972, the disclosures of which are hereby incorporated by reference.

In another preferred embodiment of my invention, initially diffusible dye image-providing materials are employed such as dye developers, including metal-complexed dye developers such as those described in U.S. Pat. Nos. 3,453,107; 3,544,545; 3,551,406; 3,563,739; 3,597,200, and 3,705,184, and oxichromic developers as described and claimed in U.S. Pat. No. 3,880,658 by my coworkers Lestina and Bush, issued Apr. 29, 1975, the disclosure of which are hereby incorporated by reference. When oxichromic developers are employed, the image is formed by the diffusion of the oxichromic developer to the dye image-receiving layer where it undergoes chromogenic oxidation to form an image dye.

The film unit of the present invention may be used to produce positive images in single- or multicolors, as well as in black and white. In a three-color system, each silver halide emulsion layer of the film assembly will have associated therewith a dye image-providing mmaterial capable of providing a dye having a predominant spectral absorption within the region of the visible spectrum to which said silver halide emulsion is sensitive, i.e., the blue-sensitive silver halide emulsion layer will have a yellow dye image-providing material associated therewith, the green-sensitive silver halide emulsion layer will have a magenta dye image-providing material associated therewith, and the red-sensitive silver halide emulsion layer will have a cyan dye image-providing material associated therewith. The dye image-providing material associated with each silver halide emulsion layer may be contained either in the silver halide emulsion layer itself or in a layer contiguous the silver halide emulsion layer.

The concentration of the dye image-providing materials that are employed in the present invention may be varied over a wide range depending upon the particular compound employed and the results which are desired. For example, the dye image-providing compounds may be coated as dispersions in layers by using coating compositions containing a weight ratio between about 0.25 and about 4 of the dye image-providing compound to the hydrophilic film-forming natural material or synthetic polymer binder, such as gelatin, polyvinyl alcohol, etc, which is adapted to be permeated by aqueous alkaline processing composition.

Generally, most silver halide developing agents can be employed to develop the silver halide emulsions in the photographic elements of this invention. The developer may be employed in the photosensitive element to be activated by the alkaline processing composition. Specific examples of developers which can be employed in this invention include:

hydroquinone
N-methylaminophenol
Phenidone (1-phenyl-3-pyrazolidinone)
Dimezone (1-phenyl-4,4-dimethyl-3-pyrazolidinone)
aminophenols
N-N-diethyl p-phenylenediamine
3-methyl-N,N-diethyl-p-phenylenediamine
N,N,N',N'-tetramethyl-p-phenylenediamine
4-hydroxymethyl-4-methyl-1-phenyl-3-pyrazolidinone
etc.

In using redox dye releaser compounds in this invention, diffusible dye images are produced as a function of development of the silver halide emulsions. If the silver halide emulsion employed forms a direct-positive silver image, such as a direct-reversal internal-image emulsion or a solarizing emulsion, which is developable in unexposed areas, a positive image can be obtained on the dye image-receiving layer when redox releasers are employed which release dye where oxidized. After exposure of the film unit, the alkaline processing composition permeates the various layers to initiate development in the exposed photosensitive silver halide emulsion layers. The development agent present in the film unit develops each of the silver halide emulsion layers in the unexposed areas (since the silver halide emulsions are direct-positive ones), thus causing the developing agent to become oxidized imagewise corresponding to the unexposed areas of the direct-positive silver halide emulsion layers. The oxidized developing agent then crossoxidizes the redox dye releaser compound, the oxidized form of which either releases directly or undergoes a base-catalyzed reaction to release the preformed dyes or the dye precursors imagewise as a function of the imagewise exposure of each of the silver halide emulsion layers. At least a portion of the imagewise distributions of diffusible dyes or dye precursors diffuses to the image-receiving layer to form a positive image of the original subject.

Internal-image silver halide emulsions useful in the above-described embodiment are direct-positive emulsions that form latent images predominantly inside the silver halide grains, as distinguished from silver halide grains that form latent images predominantly on the surface thereof. Such internal-image emulsions were described by Davey et al. in U.S. Pat. No. 2,592,250, issued Apr. 8, 1952, and elsewhere in the literature. Other useful emulsions are described in U.S. Pat. Nos. 3,761,276; 3,761,266, and 3,761,267, all issued Sept. 25, 1973. Internal-image silver halide emulsions can be defined in terms of the increased maximum density obtained when developed to a negative silver image with "internal-type" developers over that obtained when developed with "surface-type" developers. Suitable internal-image emulsions are those which, when measured according to normal photographic techniques by coating a test portion of the silver halide emulsion on a transparent support, exposing to a lightintensity scale having a fixed time between 0.01 and 1 second, and developing for 3 minutes at 20° C. in Developer A below ("internal-type" developer), have a maximum density at least 5 times the maximum density obtained when an equally exposed silver halide emulsion is developed for 4 minutes at 20° C. in Developer B described below ("surface-type" developer). Preferably, the maximum density in Developer A is at least 0.5 density unit greater than the maximum density in Developer B.

| Developer A | |
|---|---|
| hydroquinone | 15 g. |
| monomethyl-p-aminophenol sulfate | 15 g. |
| sodium sulfite (desiccated) | 50 g. |
| potassium bromide | 10 g. |
| sodium hydroxide | 25 g. |
| sodium thiosulfate | 20 g. |
| water to make one liter | |

| Developer B | |
|---|---|
| p-hydroxyphenylglycine | 10 g. |
| sodium carbonate | 100 g. |
| water to make one liter | |

The internal-image silver halide emulsions, when processed in the presence of fogging or nucleating agents, provide direct-positive silver images. Such emulsions are particularly useful in the above-described embodiment. Suitable fogging agents include the hydrazines disclosed by Ives, U.S. Pat. Nos. 2,588,982, issued Mar. 11, 1952, and 2,563,785, issued Aug. 7, 1951; the hydrazines and hydrazones disclosed by Whitmore, U.S. Pat. No. 3,227,552, issued Jan. 4, 1966; hydrazone quaternary salts described in British Pat. No. 1,283,835 and U.S. Pat. No. 3,615,615; hydrazone-containing polymethine dyes described in U.S. Pat. No. 3,718,470; and the fogging agents disclosed in copending application Ser. Nos. 601,891 and 601,888 of Leone et al., filed Aug. 6, 1975 both now abandoned, or mixtures thereof. The quantity of fogging agent employed can be widely varied, depending upon the results desired. Generally, the concentration of fogging agent is from about 0.4 to about 8 g per mole of silver in the photosensitive layer in the photosensitive element or from about 0.1 to about 2 g per liter of developer if it is located in the developer. The fogging agents described in U.S. Pat. Nos. 3,615,615 and 3,718,470, however, are preferably used in concentrations of 50 to 400 mg per mole of silver in the photosensitive layer.

Typical useful direct-positive emulsions are disclosed in U.S. Pat. Nos. 3,227,552 by Whitmore, issued Jan. 4, 1966; 3,761,276 by Evans, issued Sept. 25, 1973; 3,761,267 by Gilman et al.; 3,761,266 by Milton; 3,703,584 by Motter, and the like.

In other embodiments, the direct-positive emulsions can be emulsions which have been fogged either chemically or by radiation on the surface of the silver halide grains to provide for development to maximum density without exposure. Upon exposure, the exposed areas do not develop, thus providing for image discrimination and a positive image. Silver halide emulsions of this type are very well known in the art and are disclosed, for example, in U.S. Pat. Nos. 3,367,778 by Berriman, issued Feb. 6, 1968; and 3,501,305; 3,501,306 and 3,501,307 by Illingsworth, all issued Mar. 17, 1970.

In still other embodiments, the direct-positive emulsions can be of the type described by Mees and James, *The Theory of the Photographic Process*, published by MacMillan Company, New York, New York, 1966, pages 149 through 167.

The various silver halide emulsion layers of a color film assembly of the invention can be disposed in the usual order, i.e., the blue-sensitive silver halide emulsion layer first with respect to the exposure side, followed by the green-sensitive and red-sensitive silver halide emulsion layers. If desired, a yellow dye layer or a yellow colloidal silver layer can be present between the blue-sensitive and green-sensitive silver halide emulsion layer for absorbing or filtering blue radiation that may be transmitted through the blue-sensitive layer. If desired, the selectively sensitized silver halide emulsion layers can be disposed in a different order, e.g., the blue-sensitive layer first with respect to the exposure side, followed by the red-sensitive and green-sensitive layers.

The rupturable container employed in this invention can be of the type disclosed in U.S. Pat. Nos. 2,543,181; 2,643,886; 2,653,732; 2,723,051; 3,056,492; 3,056,491, and 3,152,515. In general, such containers comprise a rectangular sheet of fluid- and air-impervious material folded longitudinally upon itself to form two walls which are sealed to one another along their longitudinal and end margins to form a cavity in which processing solution is contained.

In a color photographic film unit according to this invention, each silver halide emulsion layer containing a dye image-providing material or having the dye image-providing material present in a contiguous layer may be separated from the other silver halide emulsion layers in the negative portion of the film unit by materials including gelatin, calcium alginate, or any of those disclosed in U.S. Pat. No. 3,384,483, polymeric materials such as polyvinylamides as disclosed in U.S. Pat. No. 3,421,892 or any of those described in French Pat. No. 2,028,236 or U.S. Pat. Nos. 2,992,104; 3,043,692; 3,044,873; 3,061,428; 3,069,263; 3,069,264; 3,121,011, and 3,427,158.

Generally speaking, except where noted otherwise, the silver halide emulsion layers in the invention comprise photosensitive silver halide dispersed in gelatin and are about 0.25 to 5 microns in thickness; the dye image-providing materials are dispersed in an aqueous alkaline solution-permeable polymeric binder, such as gelatin, as a separate layer about 0.25 to 5 microns in thickness; and the alkaline solution-permeable polymeric interlayers, e.g., gelatin, are about 0.25 to 5 microns in thickness. Of course, these thicknesses are approximate only and can be modified according to the product desired.

The alkaline solution-permeable, light-reflective layer employed in certain embodiments of photographic film units of this invention can generally comprise any opacifier dispersed in a binder as long as it has the desired properties. Particularly desirable are white light-reflective layers, since they would be aesthetically pleasing backgrounds on which to view a transferred dye image and would also possess the optical properties desired for reflection of incident radiation. Suitable opacifying agents include titanium dioxide, barium sulfate, zinc oxide, barium stearate, silver flake, silicates, alumina, zirconium oxide, zirconium acetyl acetate, sodium zirconium sulfate, kaolin, mica, or mixtures thereof in widely varying amounts depending upon the degree of opacity desired. The opacifying agents may be dispersed in any binder such as an alkaline solution-permeable polymeric matrix such as, for example, gelatin, polyvinyl alcohol and the like. Brightening agents such as the stilbenes, coumarins, triazines and oxazoles can also be added to the light-reflective layer, if desired. When it is desired to increase the opacifying capacity of the light-reflective layers, dark-colored opacifying agents, e.g., pH-indicator dyes may be added to it, or carbon black, nigrosine dyes, etc, may be coated in a separate layer adjacent to the light-reflective layer.

The neutralizing layer employed in this invention which becomes operative after permeation of the processing composition through the barrier timing layer will effect reduction in the pH of the image layers from about 13 or 14 to at least 11 and preferably 5 to 8 within a short time after imbibition. For example, polymeric acids as disclosed in U.S. Pat. No. 3,362,819 or solid acids or metallic salts, e.g., zinc acetate, zinc sulfate, magnesium acetate, etc, as disclosed in U.S. Pat. No. 2,584,030 may be employed with good results. Such neutralizing or pH-lowering materials reduce the pH of the film unit after development to terminate development and substantially reduce further dye transfer and thus stabilize the dye image.

Any material can be employed as the image-receiving layer in this invention as long as the desired function of mordanting or otherwise fixing the dye images will be obtained. The particular material chosen will, of course, depend upon the dye to be mordanted. If acid dyes are to be mordanted, the image-receiving layer can contain basic polymeric mordants such as polymers of amino guanidine derivatives of vinyl methyl ketone such as described by Minsk, U.S. Pat. No. 2,882,156, issued Apr. 14, 1959, and basic polymeric mordants such as described in U.S. Pat. Nos. 3,709,690; 3,625,694; 3,898,088 by Cohen et al, issued Aug. 5, 1975; and 3,859,096 by Burness et al, issued Jan. 7, 1975. Other mordants useful in this invention include poly-4-vinylpyridine, the 2-vinyl pyridine polymer metho-p-toluene sulfonate and similar compounds described by Spraque et al., U.S. Pat. No. 2,484,430, issued Oct. 11, 1949, and cetyl trimethylammonium bromide, etc. Effective mordanting compositions are also described in U.S. Pat. Nos. 3,271,148 by Whitmore and 3,271,147 by Bush, both issued Sept. 6, 1966, and in U.S. Pat. No. 3,958,995, issued May 25, 1976 by Campbell et al.

Other materials useful in the dye image-receiving layer include alkaline solution-permeable polymeric layers such as N-methoxymethyl polyhexylmethylene adipamide, partially hydrolyzed polyvinyl acetate and other materials of a similar nature. Generally, good results are obtained when the image-receiving layer, preferably alkaline solution-permeable, is transparent and about 0.25 to about 5$\mu$ in thickness. This thickness, of course, can be modified depending upon the result desired. The image-receiving layer can also contain ultraviolet absorbing materials, to protect the mordanted dye images from fading due to ultraviolet light, and brightening agents such as the stilbenes, coumarins, triazines, oxazoles, dye stabilizers such as the chromanols, alkylphenols, etc.

The alkaline processing composition employed in this invention is the conventional aqueous solution of an alkaline material, e.g., sodium hydroxide, sodium carbonate or an amine such as diethylamine, preferably processing a pH in excess of 11, and preferably containing a developing agent as described previously. The solution also preferably contains a viscosity-increasing compound such as a high-molecular-weight polymer, e.g., a water-soluble ether inert to alkaline solutions such as hydroxyethyl cellulose or alkali metal salts of carboxymethyl cellulose such as sodium carboxymethyl cellulose. A concentration of viscosity-increasing compound of about 1 to about 5 percent by weight of the processing composition is preferred which will impart thereto a viscosity of about 100 cps to about 200,000 cps. In certain embodiments of this invention, an opacifying agent, e.g., $TiO_2$, carbon black, indicator dyes, etc, may be added to the processing composition. In addition, ballasted indicator dyes and dye precursors may also be present in the photographic film unit as a separate layer on the exposure side of the photosensitive layers, the indicator dyes being preferably transparent during exposure and becoming colored or opaque after contact with alkali from the processing composition.

The support for the photographic elements of this invention can be any material as long as it does not deleteriously affect the photographic properties of the film unit and is dimensionally stable. Typical flexible sheet materials include cellulose nitrate film, cellulose acetate film, poly(vinyl acetal) film, polystyrene film, poly(ethylene terephthalate) film, polycarbonate film, poly-$\alpha$-olefins such as polyethylene and polypropylene film, and related films or resinous materials. The support is usually about 2 to 9 mils (50 to 225 μm) in thickness. Ultraviolet-absorbing materials may also be included in the supports or as a separate layer on the supports if desired.

The silver halide emulsions useful in this invention are well known to those skilled in the art and are described in *Product Licensing Index,* Volume 92, December, 1971, publication 9232, pages 107 through 110.

The following examples further illustrate the present invention.

EXAMPLE 1

Adhesive Composition Containing Linear Block Copolymer

An adhesive composition was prepared by mixing two commercial materials, namely 8 grams of Borden's HA6164 ethylenevinyl acetate copolymer adhesive with 2 grams of Shell Chemical Company's KRATON 1102 (linear block copolymer of polystyrene and polybutadiene) in 50 ml of toluene. This mixture was then heated to 60° C. and stirred until all components were dissolved (about 2 hours).

EXAMPLE 2

Comparison of Superior Bonding Strength of Adhesive Over Individual Components This example is a comparison of the bonding strength of the adhesive of the present invention to the strengths of its individual components.

Spacer rail substrates made of polyethylene terephthalate subbed with poly(acrylonitrile-co-vinylidene chloride-co-acrylic acid) (weight ratio 14.1:79.9:6) were coated with the adhesive composition of Example 1 and with similar adhesives having different proportions of copolymers with a 0.004-inch (0.01 cm) coating knife. After drying at room temperature for about 16 hours, then under vacuum at about 50° C. for 1 hour, strips of these coated substrates were bonded to cover sheets having barrier timing layers made of dried latex terpolymers such as disclosed in U.S. Ser. No. 676,945 of Hannie. Bonds were formed by use of heat and a pressure roller on the drum described below.

Two other spacer rail substrates were coated with Borden's HA6164 adhesive and KRATON 1102, respectively, and bonded to barrier timing layers in similar fashion to serve as controls.

Adhesive strength was determined by peel tests using an Instron testing machine with the following equipment and procedure. Samples bonded on the drum were peeled at a 90° angle at various rates and temperatures.

EQUIPMENT

The drum peel test equipment consisted of a cylindrical test drum mounted on four Teflon nesting rollers. The drum was made of ceramic or metal and was surfaced with any desired material such as a film of cover sheet with the barrier timing layer upward. The drum rotated freely on the rollers and was heated with an axially positioned 2000-watt, General Electric 2M/T3/1CL 230-250 v, quartz infrared lamp or was cooled by a stream of air or inert gas which had been refrigerated by passing through a metal coil immersed in "dry ice". This equipment was mounted on the moving crosshead of an Instron Tensile Testing Machine. The surface temperature of the drum was controlled by several means including a Cole-Parmer thermistor probe and a YSI Model 72 Proportional Temperature Controller. The temperature of the surface was measured by a thermocouple and was displayed by a Data Technology Corporation Millivolt Meter.

The Peel Test

In preparation for a peel experiment, the drum and its covering of desired substrate was heated to the desired bonding temperature and a test strip 0.5 inch (1.25cm) wide and 12 inches (30.5cm) long was wrapped circumferentially around it with the adhesive on the test strip against the substrate on the drum. The bonding conditions used depended on the flow properties of the adhesive, but in all cases a mechanically actuated, heated 1.5 Kg bonding roller was passed at 1 inch/minute (2.54cm/minute), over the test strip. The goal was to achieve a defect-free bond of the adhesive to the cover sheet or other substrate on the drum.

One end of the test strip was then attached to the Instron load cell and the temperature was adjusted to 5° C. or any other desired temperature. The test was carried out by traversing the crosshead of the Instron downwards, at the rate of 12 inches/minute (30.5cm/minute), or any other desired rate, for a distance of about 1 inch (2.54cm). The drum rotated as the test strip was peeled from it so that the peel angle remained constant at 90 degrees. Other rates, such as 0.1 inches/minute, could also be used at each temperature.

The force required to peel the strip of spacer rail substrate from the substrate on the drum was recorded by a strip chart recorder which ran at 10 inches (25.4cm) per minute. Thus, on completing a measurement at each temperature and each rate, one has a recording of force in grams for that particular temperature and rate of peel.

The results of such peel strength tests are given in Table I for a series of adhesives of varying composition at a peel temperature of 5° C. and a peel rate of 12 inches/minute when bonded to the so-called "single timing layer" of the cover sheet.

TABLE I

| Composition | Bonding Temperature ° C | KRATON 1102 (wt. %) | Borden HA6164 (wt. %) | Single-Barrier Timing Layer Peel Strength at 5° C in g/inch (g/cm) |
|---|---|---|---|---|
| Control 1 | 90 | 100 | 0 | 100 (39) |
| Example 1 | 120 90 | 10 | 600 (237) | |
| | 120 | 50 | 50 | 1150 (453) |
| | 100 | 20 | 80 | 2500 (986) |
| | 90 | 10 | 90 | >1900*(748) |
| | 90 | 15 | 85 | >1900*(748) |
| | 90 | 5 | 95 | 1150 (453) |
| Control 2 | 80 | 0 | 100 | 350 (138) |

*Test strip broke at this point

These tests clearly show the unexpected strength exhibited by the adhesives of the present invention at low temperatures over the individual components. In fact, the improved strength is greater than the sum of the individual component strengths.

EXAMPLE 3

Bonding Strength of Adhesive with Another Barrier Timing Layer

The adhesive composition of Example 1 was tested as in Example 2 except the spacer rail substrate was bonded to a cover sheet having a "double" barrier timing layer similar to those taught in U.S. Ser. No. 676,947 of Hannie et al., namely a layer having two contiguous layers, said layer being bonded to the spacer rail substrate comprising poly(ethylene terephthalate) subbed with poly(acrylonitrile-co-vinylidene chloride-co-acrylic acid) (weight ratio 14.1:79.9:6). Peel test strength of the adhesive at 5° C. and a 12 inch/minute (30.5cm/min) rate was about 1900 g/inch (748 g/cm), clearly well above the strengths of the control adhesives of Example 2.

EXAMPLE 4

Adhesive Composition Containing Radial Block Copolymer

One gram of SOLPRENE 406, a radial block copolymer, was mixed with 9.0 grams of the Borden HA6164 ethylene-vinyl acetate adhesive in 50 ml toluene at 60° C. until all materials were dissolved. The resulting adhesive was tested as in Example 2 to determine its bonding strength. Peel test strength at 5° C. and a 12 inch/minute (30.5cm/minute) rate was about 1200 g/inch (472 g/cm), also considerably greater than the strength of the control adhesives of Example 2.

EXAMPLE 5

Adhesive Bonding Strengths Over a Range of Temperatures

This is a comparison of the bonding strengths of the adhesive compositions of the present invention from Examples 1 and 2 to the strengths of the individual copolymer components used as control adhesives in Example 2 over a range of temperatures. The adhesives were tested by bonding spacer rail substrates [poly-(ethylene terephthalate)] to either of the barrier timing layers of Examples 2 and 3. Peel test strength was determined as in Example 2, except at several temperatures. Table II lists the results of various adhesives bonding a substrate to a "single" barrier timing layer of U.S. Ser. No. 676,945 of Hannie. Table III lists similar results when a "double" barrier timing layer of U.S. Ser. No. 676,947 of Hannie et al. was used.

It can be clearly seen that the compositions of the present invention exhibit far superior bonding strengths over the formulations of the prior art at temperatures less than 70° C. and particularly below 25° C. It is also seen that the preferred compositions comprising 10 to 30 weight percent of the block copolymers are exceptionally strong adhesives.

TABLE II

| Block Copolymer | Weight Percent | Acetate Copolymer | Weight Percent | Bonding Temp. ° C | Single-Barrier Timing Layer Peel Strength (g/in) at 12"/minute 5° C | 10° C | 15° C | 25° C | 35° C | 50° C | 70° C |
|---|---|---|---|---|---|---|---|---|---|---|---|
| Control 2 - | 0 | Borden HA6164 | 100 | 80 | $340^{C}$ | $440^{C}$ | $660^{C}$ | $970^{C}$ | $1590^{A}$ | $1180^{A}$ | $100^{C}$ |
| KRATON 1102 | 5 | Borden HA6164 | 95 | 90 | $1150^{C}$ | $1410^{C}$ | $1570^{C}$ | $2200^{AC}$ | $1690^{A}$ | $990^{A}$ | $150^{C}$ |
| KRATON 1102 | 10 | Borden HA6164 | 90 | 90 | $1900^{C}$ | $2560^{C}$ | $2200^{C}$ | $1920^{A}$ | $1460^{A}$ | $1080^{A}$ | $130^{C}$ |
| KRATON 1102 | 15 | Borden HA6164 | 85 | 90 | $1860^{C}$ | $2700^{C}$ | $2460^{C}$ | $2080^{AC}$ | $1700^{A}$ | $1280^{A}$ | $210^{C}$ |
| KRATON 1102 | 20 | Borden HA6164 | 80 | 100 | 2480 | 2400 | 2340 | 2000 | 1640 | $1238^{C}$ | $156^{C}$ |
| KRATON 1102 | 50 | Borden HA6164 | 50 | 120 | $1140^{C}$ | $1500^{C}$ | $1640^{C}$ | $1720^{AC}$ | $1400^{A}$ | $1460^{A}$ | $140^{A}$ |
| KRATON 1102 | 90 | Borden HA6164 | 10 | 120 | $590^{A}$ | $580^{A}$ | $550^{A}$ | $560^{A}$ | $860^{A}$ | $870^{A}$ | $90^{C}$ |
| Control 1 - KRATON 1102 | 100 | — | 0 | 90 | $110^{A}$ | $134^{A}$ | $270^{A}$ | $172^{A}$ | $204^{A}$ | $40^{A}$ | $54^{A}$ |
| KRATON 1101 | 10 | Borden HA6164 | 90 | 105 | $760^{C}$ | $890^{C}$ | $1030^{C}$ | $1440^{C}$ | $1580^{A}$ | $1000^{A}$ | $180^{C}$ |
| SOLPRENE 406 | 10 | Borden HA6164 | 90 | 100 | $1200^{C}$ | $1340^{C}$ | 2000 | $1360^{A}$ | $1100^{A}$ | $1044^{A}$ | $192^{C}$ |

$^{A}$=Adhesive Failure at the Interface
$^{C}$=Cohesive Failure of the Adhesive
$^{AC}$=Both Adhesive and Cohesive Failure

TABLE III

| Block Copolymer | Weight Percent | Acetate Copolymer | Weight Percent | Bonding Temp. ° C | Double-Barrier Timing Layer Peel Strength (g/in) at 12"/minute 5° C | 10° C | 15° C | 25° C | 35° C | 50° C | 70° C |
|---|---|---|---|---|---|---|---|---|---|---|---|
| Control 2 - | 0 | Borden HA6164 | 100 | 80 | $510^{C}$ | $1040^{C}$ | $1080^{C}$ | $1960^{A}$ | $1160^{A}$ | $1380^{A}$ | $160^{C}$ |
| KRATON 1102 | 20 | Borden HA6164 | 80 | 100 | $1860^{C}$ | $2360^{C}$ | $2040^{C}$ | $1660^{AC}$ | $1410^{AC}$ | $980^{AC}$ | $60^{C}$ |
| Control 1 - KRATON 1102 | 100 | Borden HA6164 | 0 | 120 | $560^{A}$ | $390^{AC}$ | $420^{AC}$ | $480^{AC}$ | $620^{A}$ | $460^{A}$ | $140^{A}$ |
| Control 3 - | 0 | Commercial pure ethylene/vinyl acetate | 100 | 85 | $850^{A}$ | $960^{A}$ | $790^{A}$ | $800^{A}$ | $800^{A}$ | $860^{A}$ | $170^{C}$ |
| KRATON 1102 | 20 | Commercial pure ethylene/vinyl acetate | 80 | — | $2880^{A}$ | $1580^{A}$ | $1080^{A}$ | $1680^{A}$ | $960^{A}$ | $1840^{AC}$ | $120^{C}$ |
| *KRATON 1102 | 20 | Commercial pure ethylene/vinyl acetate | 48 | — | $930^{A}$ | $2160^{A}$ | $1760^{A}$ | $1480^{A}$ | $1240^{A}$ | $1000^{A}$ | $220^{C}$ |

$^{A}$=Adhesive Failure
$^{C}$=Cohesive Failure
$^{AC}$=Both Adhesive and Cohesive Fail
*Additionally containing 30 weight percent of tackifying resin ester PENTALYN C (Hercules) and 2 weight percent of CASTORWAX (Baker Castor Oil Company)

Other useful adhesive compositions having varied proportions of components which exhibited superior bonding strengths at low temperatures with both "single" and "double" barrier timing layers include those listed in Table IV below.

TABLE IV

| Block Copolymer | Type | Weight Percent | Vinyl Acetate Copolymer | Weight Percent |
|---|---|---|---|---|
| KRATON 101 | linear styrene-butadiene | 10–90 | Borden HA6164 | 90–10 |
| KRATON 102 | linear styrene-butadiene | 10–90 | Borden HA6164 | 90–10 |
| KRATON 1107 | linear styrene-isoprene | 10–90 | Borden HA6164 | 90–10 |
| KRATON GX6500 | linear styrene-ethylene propylene rubber | 10–90 | Borden HA6164 | 90–10 |
| KRATON 1101 | linear styrene-butadiene | 10–90 | Borden HA6164 | 90–10 |
| SOLPRENE 411C | radial styrene-butadiene | 10–90 | Borden HA6164 | 90–10 |
| SOLPRENE 414 | radial styrene-butadiene | 10–90 | Borden HA6164 | 90–10 |

EXAMPLE 6

High Temperature Strength of Adhesives

This is a comparison of low and high temperature strengths of an adhesive composition of the present invention and a similar adhesive composition lacking a block copolymer. Peel test strength was determined as described in Example 2 with a spacer rail substrate bonded to the barrier timing layer of a cover sheet on an image transfer element. The hot tack strength was determined by measuring the bond strength by use of calibrated springs in the DuPont spring test for hot tack, appendix B of the DuPont ELVAX Product Information Bulletin A-70569 at various high temperatures. The results shown in Table V below indicate that the adhesive composition of the present invention has unexpected improved bonding strength at low temperatures (peel strength) and at the high temperatures used for the glove box test (hot tack strength).

TABLE V

| Composition | | Peel Strength 12 in/min 5° C | (30.5 cm/min) | Hot Tack Strength-g/inch (g/cm) 93° C | 104° C | 116° C | 127° C | 138° C | 144° C |
|---|---|---|---|---|---|---|---|---|---|
| Control | 84.6 wt.% ethylene vinyl acetate copolymer; 15.4 wt.% waxes, fillers, antiblocking agents | 1409 | g/inch (552 g/cm) | 40(15.8) | 25(9.8) | 25 | 25 | 25 | 17(6.7) |
| Example 6 | 67.9 wt.% ethylene vinyl acetate copolymer; 12.6 wt.% waxes, fillers, etc., 19.5% KRATON 1102 | 2680 | g/inch (1056 g/cm) | 60(23.6) | 60 | 40 | 40 | 25 | 25 |

EXAMPLE 7

This example illustrates the ability of the mixtures of the invention to exhibit excellent peel strength when coated at low and high temperatures.

The adhesives of Example 7 comprise a mixture of 20 percent KRATON 1102 and 80 percent ethylene-vinyl acetate copolymer and was compared to the control KRATON 1102 alone at various bonding temperatures. The adhesives were coated on the poly(ethylene terephthalate) spacer layer of Example 3 and bonded to the double timing layer of Example 3 and peel strengths were tested as in Example 2. The following results are shown in Table VI.

TABLE VI

| Example | Heating Time in Toluene ° C | Time | Bonding Temp. ° C | 5° C | 15° C | 25° C | 40° C | 50° C | 60° C | 70° C |
|---|---|---|---|---|---|---|---|---|---|---|
| Control 1 (KRATON 1102) | 25 | — | 130 | 1620$^{A}$ | 1512$^{A}$ | 1360$^{A}$ | 1360$^{A}$ | 1290$^{A}$ | 740$^{A}$ | 730$^{A}$ |
| Control 2 (KRATON 1102) | 50 | 8 hrs | 130 | 960$^{A}$ | 1000$^{A}$ | 880$^{A}$ | 700$^{A}$ | 642$^{A}$ | 620$^{A}$ | 500$^{A}$ |
| Control 3 (KRATON 1102) | 61 | 1 hr | 130 | 94$^{A}$ | 64$^{A}$ | 78$^{A}$ | 70$^{A}$ | 60$^{A}$ | 86$^{A}$ | 110$^{A}$ |
| Example 7A | 25 | — | 100 | >3760 | 3800$^{C}$ | 2920$^{C}$ | 1900$^{C}$ | 1440$^{AC}$ | 590$^{C}$ | 115$^{C}$ |
| Example 7B | 50 | 8 hrs | 100 | 4100$^{C}$ | 3400$^{C}$ | 2280$^{C}$ | 2090$^{C}$ | 1300$^{A}$ | 494$^{C}$ | 98$^{C}$ |
| Example 7C | 50 | 1 hr | 100 | 4100$^{C}$ | 3500$^{C}$ | 2730$^{C}$ | 2040$^{C}$ | 1280$^{C}$ | 470$^{C}$ | 118$^{C}$ |
| Example 7D | 61 | 1 hr | 100 | 3520$^{A}$ | 3140$^{C}$ | 2640$^{C}$ | 1990$^{C}$ | 1324$^{C}$ | 526$^{C}$ | 112$^{C}$ |

$^{A}$=Adhesive Failure
$^{C}$=Cohesive Failure
$^{AC}$=Both Adhesive and Cohesive Failure

EXAMPLES 8 through 12

The following are examples of various adhesive compositions of the invention in which all of the components were introduced individually into the adhesive mixtures. In Examples 8 and 12 the adhesive was coated as a ½ mil layer on 2½ mil subbed poly(ethylene terephthalate), while in Example 9–11 the adhesive was coated as a ½ mil layer on subbed spacer rail. In each case ½ inch wide strips of the adhesive coated poly(ethylene terephthalate) on spacer rail were bonded on the drum to the substrates indicated in Table VII, using the technique described in Example 2.

TABLE VII

| Example | Adhesive Composition | Weight Percent | Bonded To: | Bonding Temp. | Peel Strength (g/m) at 12"/minute 5° C | 10° C | 15° C | 25° C | 35° C | 50° C | 70° C |
|---|---|---|---|---|---|---|---|---|---|---|---|
| 8 | Ethylene-vinyl acetate copolymer | 46.9 | Double Barrier | 100 | 2320$^{A}$ | 2340$^{A}$ | 1820$^{A}$ | 1000$^{A}$ | 780$^{A}$ | 930$^{A}$ | 230$^{A}$ |
| | a rosin ester | 28.8 | Timing | | | | | | | | |
| | glyceryl tri(12- | 2.3 | Layer) | | | | | | | | |

TABLE VII-continued

| Example | Adhesive Composition | Weight Percent | Bonded To: | Bonding Temp. | Peel Strength (g/m) at 12"/minute 5° C | 10° C | 15° C | 25° C | 35° C | 50° C | 70° C |
|---|---|---|---|---|---|---|---|---|---|---|---|
| | hydroxy stearate) | | | | | | | | | | |
| | N,N'-ethylenebisstearamide | 2.3 | | | | | | | | | |
| | KRATON 1102 | 19.6 | | | | | | | | | |
| 9 | Ethylene-vinyl acetate copolymer | 21.0 | Double Barrier Timing Layer | 100 | 2808[A] | 1720[A] | 1400[A] | 1140[A] | 930[A] | 700[A] | 120[A] |
| | a rosin ester | 30.0 | | | | | | | | | |
| | silica | 3.0 | | | | | | | | | |
| | Ethylene-vinyl acetate copolymer | | | | | | | | | | |
| | a natural wax | 10.8 | | | | | | | | | |
| | Bisamide synthetic wax | 5.4 | | | | | | | | | |
| | KRATON 1102 | 19.0 | | | | | | | | | |
| 10 | Ethylene-vinyl acetate copolymer | 21.0 | Backing of Emulsion Cover Sheet | 100 | 1340[C] | 1680[A] | 1610[A] | 1310[A] | 1010[A] | 710[A] | 140[A] |
| | a rosin ester | 30.0 | | | | | | | | | |
| | silica | 3.0 | | | | | | | | | |
| | Ethylene-vinyl acetate copolymer | 13.5 | | | | | | | | | |
| | a natural wax | 9.5 | | | | | | | | | |
| | Bisamide synthetic wax | 4.0 | | | | | | | | | |
| | KRATON 1102 | 19.0 | | | | | | | | | |
| 11 | same as above | same as above | Element Containing Emulsion Layer | 100 | 1220[A] | 1320[A] | 1220[A] | 1560[A] | 1560[A] | 1000[A] | 90[C] |
| 12 | Ethylene-vinyl acetate copolymer | 41 | Double Barrier Timing Layer | 100 | 1900[A] | 1610[A] | 1400[A] | 1200[A] | 1060[A] | 800[A] | 126[C] |
| | a rosin ester | 25 | | | | | | | | | |
| | glyceryl tri(12-hydroxy stearate) | 2 | | | | | | | | | |
| | N,N'-ethylenebis-stearamide | 2 | | | | | | | | | |
| | KRATON 1102 | 30 | | | | | | | | | |

[A]=Adhesive Failure
[C]=Cohesive Failure
[AC]=Both Adhesive and Cohesive Failure The invention has been described in detail with particular reference to certain preferred embodiments thereof, but it will be understood that variations and modifications can be effected within the spirit and scope of the invention.

What I claim is:

1. In a radiation sensitive element comprising a support and having thereon at least one radiation sensitive layer, and at least one adhesive layer, the improvement wherein the adhesive layer contains a non-pressure sensitive, heat sealable adhesive composition having high bond strength at temperatures below about 750° C., the composition consisting essentially of a mixture of:

A. from about 1 to about 99 percent by weight of a block copolymer formed from about 10 to about 50 percent by weight of end blocks of at least one vinylbenzene and from about 90 to about 50 percent by weight of at least one conjugated diolefin; and B. from about 99 to about 1 percent by weight of a copolymer formed from about 40 to about 85 percent by weight of at least one alkene having up to 5 carbon atoms in its backbone and from about 60 to about 15 percent by weight of vinyl acetate.

2. The element of claim 1 wherein the block copolymer is present in a range of from about 10 to about 30 percent by weight.

3. The element of claim 1 wherein the glass transition temperature of the diolefin blocks of the block copolymer is within the range of from about −80° to about 0° C., and the glass transition temperature of the vinylbenzene blocks is within the range of from about 50° to about 150° C.

4. The element of claim 1 wherein the adhesive composition has a peel strength at 5° C. which exceeds about 394 g/cm.

5. The element of claim 1 wherein the alkene-vinyl acetate copolymer has a glass transition temperature of from about −50° to about 30° C.

6. The element of claim 1 wherein the block copolymer has a molecular weight within the range of from about 20,000 to about 375,000; and the alkene-vinyl acetate copolymer has a molecular weight within the range of from about 10,000 to about 100,000.

7. The element of claim 1 wherein copolymer A is formed from styrene, and butadiene or isoprene and copolymer B is a copolymer of ethylene and vinyl acetate.

8. The element of claim 1 wherein the radiation sensitive layer is a light sensitive silver halide layer.

9. The radiation sensitive element of claim 1 wherein the adhesive composition additionally comprises one or more plasticizers.

10. The radiation sensitive element of claim 1 wherein the adhesive composition additionally comprises one or more mineral fillers.

11. The radiation sensitive element of claim 1 wherein the adhesive composition additionally comprises one or more pigments.

12. The radiation sensitive element of claim 1 wherein the adhesive composition additionally comprises one or more antioxidants.

13. The radiation sensitive element of claim 1 wherein the adhesive composition additionally comprises one or more UV-absorbers.

14. The radiation sensitive element of claim 1 wherein the adhesive composition additionally comprises one or more resin extenders.

15. The radiation sensitive element of claim 1 wherein the adhesive composition additionally comprises one or more waxes.

16. In a photographic element comprising a support and having thereon at least one light sensitive silver halide layer, and at least one adhesive layer, the improvement wherein the adhesive layer contains a non-pressure sensitive, heat sealable adhesive composition having high bonding strength at temperatures below about 75° C., the composition consisting essentially of a mixture of:

A. from about 10 to about 30 percent by weight of a block copolymer formed from about 20 to about 30 percent by weight of end blocks of styrene and from about 70 to about 80 percent by weight of butadiene or isoprene, the block copolymer having a molecular weight within the range of from about 43,000 to about 195,000; and B. from about 70 to about 90 percent by weight of a copolymer formed from about 65 to about 75 percent by weight of ethylene and from about 35 to about 25 percent by weight of vinyl acetate, the copolymer having a molecular weight within the range of from about 10,000 to about 100,000.

17. In a photographic film unit comprising:

A. a support having thereon at least one photosensitive silver halide emulsion layer having associated therewith a dye image-providing material;

B. a dye image-receiving layer;

C. means for discharging an alkaline processing composition within the film unit in contact with the photosensitive layer;

D. a neutralizing layer for neutralizing the alkaline processing composition;

E. a barrier timing layer which is permeable by the alkaline processing composition after a predetermined time located between the neutralizing layer and the photosensitive silver halide emulsion;

the film unit containing a silver halide developing agent, and at least one adhesive layer, the improvement wherein the adhesive layer contains a non-pressure sensitive, heat sealable adhesive composition having high bonding strength at temperatures below about 75° C., consisting essentially of a mixture of:

A. from about 1 to about 99 percent by weight of a block copolymer formed from about 10 to about 50 percent by weight of end blocks of at least one vinylbenzene and from about 90 to about 50 percent by weight of at least one conjugated diolefin; and B. from about 99 to about 1 percent by weight of a copolymer formed from about 40 to about 85 percent by weight of at least one alkene having up to 5 carbon atoms in its backbone and from about 60 to about 15 percent by weight of vinyl acetate.

18. The film unit of claim 17 wherein the block copolymer is present in the alkaline composition in a range of from about 10 to about 30 percent by weight.

19. The film unit of claim 17 wherein the glass transition of the diolefin blocks of the block copolymer is within the range of from about −80° to about 0° C., and the glass transition temperature of the vinylbenzene blocks is within the range of from about 50 to about 150° C.

20. The film unit of claim 17 wherein the adhesive composition has a peel strength at 5° C. which exceeds about 394 g/cm.

21. The film unit of claim 17 wherein the alkenevinyl acetate copolymer has a glass transition temperature of from about −50° to about 30° C.

22. The film unit of claim 17 wherein the block copolymer has a molecular weight within the range of from about 20,000 to about 375,000; and the alkenevinyl acetate copolymer has a molecular weight within the range of from about 10,000 to about 100,000.

23. The film unit of claim 17 wherein copolymer A is formed from styrene, and butadiene or isoprene and copolymer B is a copolymer of ethylene and vinyl acetate.

24. The film unit of claim 17 wherein the adhesive composition bonds the barrier timing layer to a spacer rail substrate which is located between the barrier timing layer and the outermost layer of the photosensitive element.

25. The film unit of claim 17 wherein:

A. the dye image-receiving layer is located between the support and the silver halide emulsion layer; and B. the film unit also includes a transparent cover sheet over the layer outermost from the support.

26. The film unit of claim 25 wherein the transparent cover sheet contains in order the neutralizing layer and the barrier timing layer.

27. The film unit of claim 25 wherein the discharging means is a rupturable container containing the alkaline processing composition and an opacifying agent, the container being so positioned during processing of the film unit that a compressive force applied to the container will effect a discharge of the container's contents between the cover sheet and the outermost layer of the photosensitive element.

28. The film unit of claim 17 comprising:

A. a photosensitive element comprising a transparent support having thereon the following layers in sequence: an image-receiving layer; an alkaline solution-permeable, light-reflective layer; an alkaline solution-permeable opaque layer; a red-sensitive silver halide emulsion layer having a ballasted redox cyan dye releaser associated therewith; a green-sensitive silver halide emulsion layer having a ballasted redox magenta dye releaser associated therewith; and a blue-sensitive silver halide emulsion layer having a ballasted redox yellow dye releaser associated therewith;

B. a cover sheet superposed over the blue-sensitive silver halide emulsion layer and comprising a transparent support coated with the neutralizing layer the barrier timing layer, and the adhesive composition coated adjacent to the barrier timing layer outermost from the support; and C. a rupturable container containing the alkaline processing composition and an opacifying agent, the container being so positioned during processing of the film unit that a compressive force applied to the container will effect a discharge of the container's contents between the cover sheet and the blue-sensitive silver halide emulsion layer.

29. The film unit of claim 28 wherein each redox dye releaser is a nondiffusible sulfonamido compound which is alkali-cleavable upon oxidation to release a diffusible sulfonamido color-providing moiety.

30. The film unit of claim 29 wherein each silver halide emulsion is a direct-positive silver halide emulsion.

31. The film unit of claim 17 wherein the dye image-receiving layer is located on one support and the photosensitive silver halide emulsion layer is located on another support.

32. In a photographic film unit comprising:

A. a support having thereon at least one photosensitive silver halide emulsion layer having associated therewith a dye image-providing material;

B. a dye image-receiving layer;

C. means for discharging an alkaline processing composition within the film unit;

D. a neutralizing layer for neutralizing the alkaline processing composition;

E. a spacer rail substrate; and

F. a barrier timing layer located between the spacer rail subtrate and the neutralizing layer and which is permeable by the alkaline processing composition after a predetermined time;

the film unit containing a silver halide developing agent, the improvement comprising the bonding of the barrier timing layer to the spacer rail substrate with a non-pressure sensitive, heat sealable adhesive composition having high bond strength at temperatures below about 75° C., consisting essentially of a mixture of:

A. from about 1 to about 99 percent by weight of a block copolymer formed from about 10 to about 50 percent by weight of end blocks of at least one vinylbenzene and from about 90 to about 50 percent by weight of at least one conjugated diolefin; and B. from about 99 to about 1 percent by weight of a copolymer formed from about 40 to about 85 percent by weight of at least one alkene having up to 5 carbon atoms in its backbone and from about 60 to about 15 percent by weight of vinyl acetate.

33. The film unit of claim 32 wherein the block copolymer is present in the adhesive composition in a range of from about 10 to about 30 percent by weight.

34. The film unit of claim 32 wherein the glass transition temperature of the diolefin blocks of the block copolymer is within the range of from about −80° to about 0° C., and the glass transition temperature of the vinylbenzene blocks is within the range of from about 50° to about 150° C.

35. The film unit of claim 32 wherein the adhesive composition has a peel strength at 5° C. which exceeds about 394 g/cm.

36. The film unit of claim 32 wherein the alkenevinyl acetate copolymer has a glass transition temperature of from about −50° to about 30° C.

37. The film unit of claim 32 wherein the block copolymer has a molecular weight within the range of from about 20,000 to about 375,000; and the alkenevinyl acetate copolymer has a molecular weight within the range of from about 10,000 to about 100,000.

38. The film unit of claim 32 wherein copolymer A is formed from styrene, and butadiene or isoprene, and copolymer B is a copolymer of ethylene and vinyl acetate.

39. In a photographic film unit comprising:

A. a support having thereon at least one photosensitive silver halide emulsion layer having associated therewith a dye image-providing material;

B. a dye image-receiving layer;

C. means for discharging an alkaline processing composition within the film unit;

D. a neutralizing layer for neutralizing the alkaline processing composition;

E. a spacer rail substrate; and

F. a barrier timing layer located between the spacer rail substrate and the neutralizing layer and which is permeable by the alkaline processing composition after a predetermined time; the film unit containing a silver halide developing agent, the improvement comprising bonding the barrier timing layer to the spacer rail substrate with a non-pressure sensitive, heat sealable adhesive composition having high bonding strength at temperatures below about 75° C., consisting essentially of a mixture of:

A. from about 10 to about 30 percent by weight of a block copolymer formed from about 20 to about 30 percent by weight of end blocks of styrene and from about 70 to about 80 percent by weight of butadiene or isoprene, the block copolymer having a molecular weight within the range of from about 43,000 to about 195,000; and B. from about 70 to about 90 percent by weight of a copolymer formed from about 65 to about 75 percent by weight of ethylene and from about 35 to about 25 percent by weight of vinyl acetate, the copolymer having a molecular weight within the range of from about 10,000 to about 100,000.

40. The film unit of claim 39 wherein:

A. the dye image-receiving layer is located between the support and the silver halide emulsion layer; and B. the film unit also includes a transparent cover sheet over the layer outermost from the support.

41. The film unit of claim 40 wherein the transparent cover sheet contains, in order, the neutralizing layer and the barrier timing layer.

42. The film unit of claim 40 wherein the discharging means is a rupturable container containing the alkaline processing composition and an opacifying agent, the container being so positioned during processing of the film unit that a compressive force applied to the container will effect a discharge of the container's contents between the cover sheet and the outermost layer of the photosensitive element.

43. The film unit of claim 40 comprising:

A. a photosensitive element comprising a transparent support having thereon the following layers in sequence: an image-receiving layer; an alkaline solution-permeable, light-reflective layer; an alkaline solution-permeable opaque layer; a red-sensitive silver halide emulsion layer having a ballasted redox cyan dye releaser associated therewith; a green-sensitive silver halide emulsion layer having a ballasted redox magenta dye releaser associated therewith; and a blue-sensitive silver halide emulsion layer having a ballasted redox yellow dye releaser associated therewith;

B. a cover sheet superposed over the blue-sensitive silver halide emulsion layer and comprising a transparent support coated with the neutralizing layer and the barrier timing layer; and C. a rupturable container containing the alkaline processing composition and an opacifying agent, the container being so positioned during processing of the film unit that a compressive force applied to the container will effect a discharge of the container's contents between the cover sheet and the blue-sensitive silver halide emulsion layer.

44. The film unit of claim 43 wherein each redox dye releaser is a nondiffusible sulfonamido compound which is alkali-cleavable upon oxidation to release a diffusible sulfonamido color-providing moiety.

45. The film unit of claim 44 wherein each silver halide emulsion is a direct-positive silver halide emulsion.

46. The film unit of claim 39 wherein the dye image-receiving layer is located on one support and the photosensitive silver halide emulsion layer is located on another support.

* * * * *

UNITED STATES PATENT AND TRADEMARK OFFICE

CERTIFICATE OF CORRECTION

PATENT NO. : 4,126,464

DATED : November 21, 1978

INVENTOR(S) : John R. Dann

It is certified that error appears in the above-identified patent and that said Letters Patent are hereby corrected as shown below:

Column 6, line 67, "photograhic" should read --photographic--;
Column 7, line 1, "radiationsensitive" should read --radiation-sensitive--;
Column 7, line 40, "to" should read --or--;
Column 15, line 42, "lightintensity" should read --light-intensity--;
Column 20, Table I, the 3rd, 4th and 5th headings over the columns, and line 2 of the table should read

--

| | | KRATON 1102 (wt. %) | Borden HA6164 (wt. %) | Single-Barrier Timing Layer Peel Strength at 5°C in g/inch (g/cm) |
|---|---|---|---|---|
| Example 1 | 120 | 90 | 10 | 600 (237) |

--;

Column 23, Table IV, the headings of the table should not be separated from the body thereof;
Column 25, line 46 "750°" should read --75°--;
Column 30, lines 5-12, "the film unit....of:" should be separate from what precedes it and flush with the left columnar margin;
Column 30, line 43, "40" should read --39--.

Signed and Sealed this

*Thirteenth* Day of *January 1981*

[SEAL]

*Attest:*

SIDNEY A. DIAMOND

*Attesting Officer*

*Commissioner of Patents and Trademarks*